US012751588B2

(12) United States Patent
Guo et al.

(10) Patent No.: US 12,751,588 B2
(45) Date of Patent: Oct. 6, 2026

(54) HAIR CUTTING ASSEMBLY AND CLEANING APPARATUS

(71) Applicants: JIANGSU MIDEA CLEANING APPLIANCES CO., LTD., Suzhou (CN); MIDEA GROUP CO., LTD., FOSHAN (CN)

(72) Inventors: Hui Guo, Suzhou (CN); Manman Chen, Suzhou (CN); Ruochen Chao, Suzhou (CN)

(73) Assignees: JIANGSU MIDEA CLEANING APPLIANCES CO., LTD., Suzhou (CN); MIDEA GROUP CO., LTD., Foshan (CN)

( * ) Notice: Subject to any disclaimer, the term of this patent is extended or adjusted under 35 U.S.C. 154(b) by 288 days.

(21) Appl. No.: 18/569,593

(22) PCT Filed: Jul. 26, 2023

(86) PCT No.: PCT/CN2023/109298

§ 371 (c)(1),
(2) Date: Dec. 12, 2023

(87) PCT Pub. No.: WO2024/103826

PCT Pub. Date: May 23, 2024

(65) Prior Publication Data

US 2025/0082145 A1 Mar. 13, 2025

(30) Foreign Application Priority Data

Nov. 17, 2022 (CN) ..... 202223054347.3

(51) Int. Cl.
*A47L 9/04* (2006.01)
*A47L 11/40* (2006.01)

(52) U.S. Cl.
CPC ..... *A47L 9/0477* (2013.01); *A47L 11/4016* (2013.01); *A47L 11/4041* (2013.01); *A47L 11/4083* (2013.01)

(58) Field of Classification Search
CPC ..... A47L 9/0477; A47L 11/4016; A47L 11/4041; A47L 11/4083
See application file for complete search history.

(56) References Cited

U.S. PATENT DOCUMENTS 11,672,393 B2 * 6/2023 Freese ..... A47L 9/0444 15/383
2006/0156880 A1 7/2006 McCambridge et al.
(Continued)

FOREIGN PATENT DOCUMENTS

CN 104248397 A * 12/2014
CN 105433880 A 3/2016
(Continued)

OTHER PUBLICATIONS

ISR received in PCT/CN2023/109298; mailed Oct. 25, 2023.
(Continued)

*Primary Examiner* — Marc Carlson
(74) *Attorney, Agent, or Firm* — K&L Gates LLP

(57) ABSTRACT

Provided are a hair cutting assembly and a cleaning apparatus. The hair cutting assembly includes: a housing; a roller brush connected to the housing and configured to rotate relative to the housing along a rotation axis; a blade assembly connected to the housing; and a comb tooth connected to the housing, and the blade assembly is adjacent to the comb tooth relative to a circumferential direction of the roller brush, and when a plane on which the rotation axis is located rotates along with the roller brush in a first rotation direction, the plane passes the comb tooth and the blade assembly in sequence.

19 Claims, 6 Drawing Sheets

(56) References Cited

U.S. PATENT DOCUMENTS

| | | | | |
|---|---|---|---|---|
| 2009/0229075 | A1* | 9/2009 | Eriksson | A46B 13/006 15/48 |
| 2014/0259521 | A1* | 9/2014 | Kowalski | A47L 9/0411 15/383 |
| 2014/0359968 | A1* | 12/2014 | Eriksson | A47L 9/0477 15/390 |
| 2020/0288930 | A1* | 9/2020 | Wells | A47L 9/0613 |
| 2024/0238997 | A1* | 7/2024 | Guo | A47L 9/0063 |

FOREIGN PATENT DOCUMENTS

| | | | | | |
|---|---|---|---|---|---|
| CN | 105982615 | A | | 10/2016 | |
| CN | 110575097 | A | | 12/2019 | |
| CN | 110809422 | A | | 2/2020 | |
| CN | 111329392 | A | * | 6/2020 | A47L 9/0477 |
| CN | 112246720 | A | | 1/2021 | |
| CN | 113116217 | A | | 7/2021 | |
| CN | 113509088 | A | | 10/2021 | |
| CN | 113729553 | A | * | 12/2021 | A47L 11/4011 |
| CN | 215605406 | U | | 1/2022 | |
| CN | 217744238 | U | * | 11/2022 | |
| CN | 218606365 | U | | 3/2023 | |
| CN | 218899300 | U | | 4/2023 | |
| DE | 102017109595 | A1 | | 11/2018 | |
| EP | 1523254 | B1 | | 2/2011 | |
| GB | 2383970 | A | | 7/2003 | |
| JP | 2017035317 | A | | 2/2017 | |
| KR | 20190019534 | A | | 2/2019 | |
| WO | WO-2014140935 | A2 | * | 9/2014 | A47L 9/0411 |

OTHER PUBLICATIONS

Written Opinion received in PCT/CN2023/109298; mailed Oct. 10, 2023.

EESR Received in EP Application No. 23840869.4; mailed Feb. 25, 2025.

The extended European search report of EP Application No. 23820729.4, dated Jun. 10, 2026.

The first office action of JP Application No. 2025-527820, dated 2026-05-12.

The first office action of JP Application No. 2025-528533, dated 2026-05-12.

* cited by examiner

HAIR CUTTING ASSEMBLY AND CLEANING APPARATUS

CROSS-REFERENCES TO RELATED APPLICATIONS

The present disclosure is a national phase application of International Application No. PCT/CN2023/109298, filed on Jul. 26, 2023, which claims the benefit of priority to Chinese Patent application Ser. No. 202223054347.3, filed with the China National Intellectual Property Administration on Nov. 17, 2022, the entireties of which are herein incorporated by reference.

FIELD

The present disclosure relates to the field of cleaning apparatuses, and particularly relates to a hair cutting assembly and a cleaning apparatus.

BACKGROUND

At present, cleaning apparatuses such as vacuum cleaners have been extensively used in gradually increasing households. As main working components of cleaning heads of the vacuum cleaners, rotary roller brushes make contact with the ground to beat and brush off dust on the ground. Slender fibrous garbage, such as hair, is likely to get wound around the roller brushes and difficult to clear, which affects the cleaning effect of the roller brushes.

In cleaning apparatuses in the related art, fibrous garbage wound around roller brushes is cut by blades, unwound and sucked away. However, when the cleaning apparatuses perform cleaning, garbage rotating along with the roller brushes will aggravate damage to the blades. Accordingly, the cutting effect of the blades on the fibrous garbage will be affected.

SUMMARY

In order to solve at least one of the above problems, embodiments of the present disclosure are to provide a hair cutting assembly.

Another embodiment of the present disclosure is to provide a cleaning apparatus having the above hair cutting assembly.

The embodiments of the present disclosure provide a hair cutting assembly. The hair cutting assembly includes: a housing; a roller brush, connected to the housing and configured to rotate relative to the housing along a rotation axis; a blade assembly connected to the housing; and a comb tooth connected to the housing, and the blade assembly is adjacent to the comb tooth relative to a circumferential direction of the roller brush, and when a plane on which the rotation axis is located rotates along with the roller brush in a first rotation direction, the plane passes the comb tooth and the blade assembly in sequence.

According to an embodiment of the hair cutting assembly provided in the present disclosure, when garbage rotates along with the roller brush in a rotation direction thereof, the garbage first makes contact with the comb tooth, and the comb tooth intercepts and cuts part of the garbage. Then the garbage adhering to the roller brush or wound around the roller brush is cut by the blade assembly. By arranging the comb tooth, the blade assembly can be protected to a great extent, damage to the blade assembly caused by garbage is reduced, effective service time of the blade assembly is ensured, and a cutting effect of the blade assembly on fibrous garbage is favorably improved.

In an embodiment, the hair cutting assembly includes a housing, a roller brush, a blade assembly and a comb tooth. The roller brush, the blade assembly and the comb tooth are all connected to the housing, and the housing mainly plays a role of a mounting carrier. Further, the roller brush may rotate relative to the housing along a rotation axis. In a further embodiment, the roller brush includes a roller and rows of bristles arranged on a circumferential sidewall of the roller. The rotation axis of the roller brush may be understood as a rotation axis of the roller. Rotation of the roller brush, in one embodiment, means that the roller drives the bristles to rotate. When the cleaning apparatus performs cleaning, the roller brush makes contact with the ground, dust on the ground is beaten by the bristles of the roller brush, and the garbage is brushed off and rolled into the housing.

Further, the blade assembly is connected to the housing. In a further embodiment, the blade assembly includes a fixed blade and a movable blade. The fixed blade is fixed relative to the housing. The movable blade is movable relative to the fixed blade. In a further embodiment, the movable blade abuts against the fixed blade. Relative movement between the movable blade and the fixed blade forms an effective cutting action, and fibrous garbage (such as hair wound around the roller brush) is cut. In a further embodiment, the housing includes a mounting housing, a first support housing and a second support housing. The roller brush is connected to the mounting housing, and the roller brush may rotate relative to the mounting housing along a rotation axis. The fixed blade is connected to the first support housing, and the movable blade is connected to the second support housing. The first support housing is connected to the mounting housing, and the second support housing is connected to the mounting housing. The first support housing is connected to the mounting housing through adhesion or welding, and the second support housing is connected to the mounting housing through adhesion or welding.

Further, the blade assembly and the comb tooth are adjacent to each other relative to a circumferential direction of the roller brush. The blade assembly and the comb tooth are located on the same side of a plane on which the rotation axis of the roller brush is located. When the plane on which the rotation axis of the roller brush is located rotates along with the roller brush in a first rotation direction, the plane passes the comb tooth and the blade assembly in sequence. When garbage rotates along with the roller brush in a rotation direction thereof, the garbage first makes contact with the comb tooth, and the comb tooth intercepts and cuts part of the garbage. Then the garbage adhering to the roller brush or wound around the roller brush is cut by the blade assembly. By arranging the comb tooth, the blade assembly can be protected to a great extent, damage to the blade assembly caused by garbage is reduced, effective service time of the blade assembly is ensured, and a cutting effect of the blade assembly on fibrous garbage is favorably improved.

One embodiment of the present disclosure provides a cleaning apparatus. The cleaning apparatus includes: the hair cutting assembly in any one of the above embodiments; a first driving member connected to a roller brush of the hair cutting assembly, and the first driving member is configured to drive the roller brush to rotate along a rotation axis; a second driving member connected to a movable blade of the hair cutting assembly, and the second driving member is configured to drive the movable blade to move relative to a fixed blade of the hair cutting assembly; and a controller connected to the first driving member, and the controller is connected to the second driving member.

According to an embodiment of the cleaning apparatus in the present disclosure, the cleaning apparatus includes the hair cutting assembly in any one of the above embodiments, a first driving member and a second driving member. In an embodiment, the first driving member is connected to a roller brush of the hair cutting assembly, and the first driving member is configured to drive a roller brush to rotate along a rotation axis. The first driving member drives the roller brush to rotate in a first rotation direction or a second rotation direction. In a further embodiment, rotation of the roller brush in the first rotation direction is forward rotation of the roller brush, and rotation of the roller brush in the second rotation direction is reverse rotation of the roller brush. When the cleaning apparatus performs cleaning, the roller brush makes contact with the ground, dust on the ground is beaten by the bristles of the roller brush, and the garbage is brushed off and rolled into a cavity of the housing.

Further, the second driving member is connected to a movable blade of the hair cutting assembly, and the second driving member is configured to drive the movable blade to move relative to a fixed blade of the hair cutting assembly. Relative movement between the movable blade and the fixed blade forms an effective cutting action, and fibrous garbage (such as hair wound around the roller brush) is cut, and a cleaning effect is improved.

Further, the controller is connected to the first driving member, and the controller is connected to the second driving member. A control method of the controller includes: determining that the roller brush is in a working state, and controlling the movable blade to be always in a moving state; determining that the roller brush is in a working state, and controlling the movable blade to intermittently move; determining that the roller brush is in a working state, controlling the movable blade to be in a moving state, and controlling the movable blade to stop moving after a time threshold; determining that the roller brush is not in a working state, and controlling the movable blade to be in a moving state; or controlling the movable blade to be in a moving state, and controlling the roller brush to reversely rotate.

The cleaning apparatus includes any one of the hair cutting assemblies in the embodiments, and therefore has the beneficial effects of any one of the above embodiments, which will not be repeated herein.

Embodiments of the present disclosure will be described in the following description.

Figure 1:
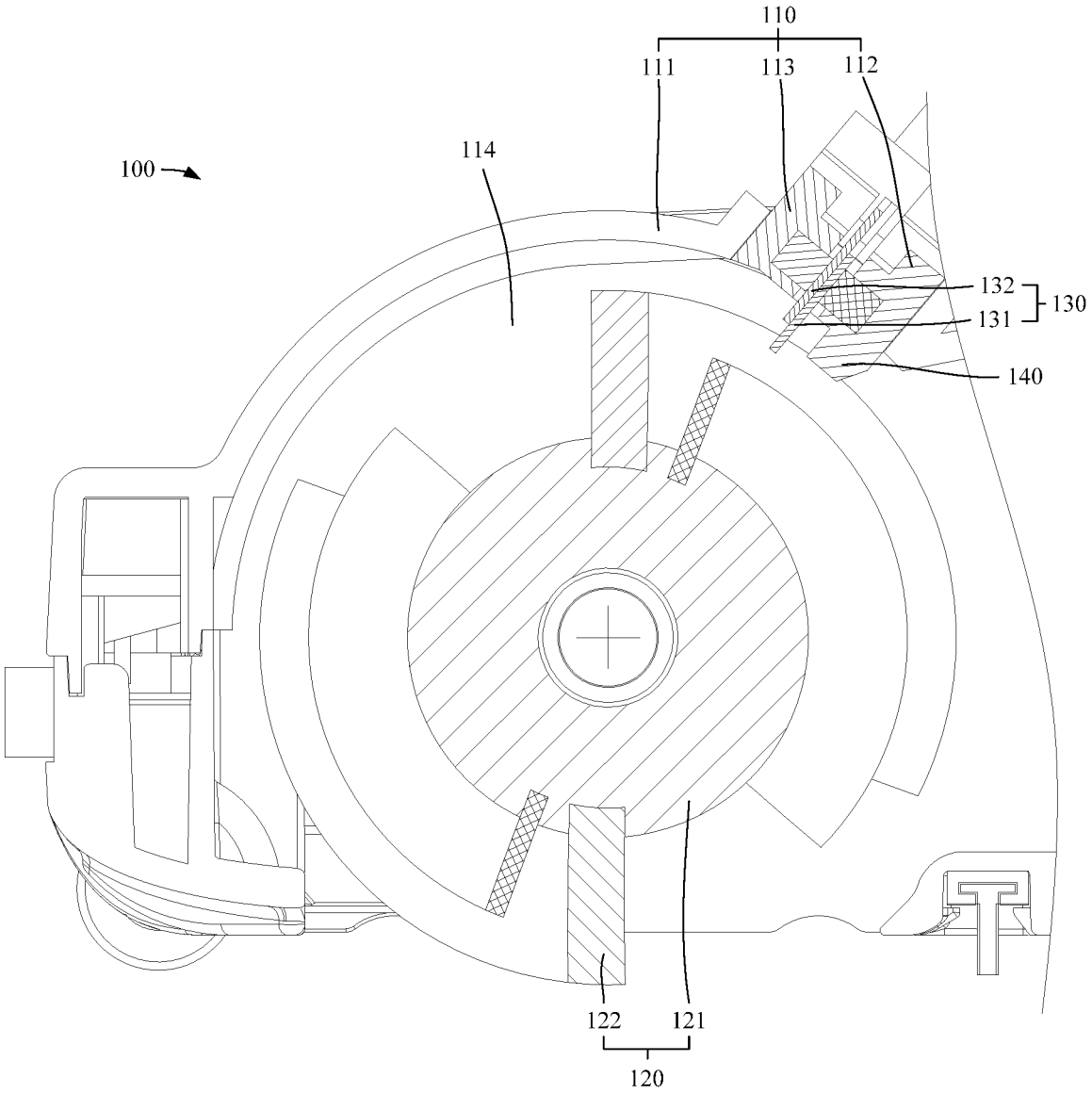
FIG. 1 shows a schematic diagram of a hair cutting assembly according to an embodiment of the present disclosure.

Corresponding relations between reference numerals and component names in FIGS. 1-8 are as follows:

100: hair cutting assembly; 110: housing; 111: mounting housing; 112: first support housing; 113: second support housing; 114: cavity; 120: roller brush; 121: roller; 122: bristle; 130: blade assembly; 131: fixed blade; 132: movable blade; 140: comb tooth; 200: cleaning apparatus; 211: first driving member; 212: second driving member; 220: controller; 230: measurement device; 241: independent switch; 242: remote control switch; 251: first storage container; and 252: second storage container.

DETAILED DESCRIPTION OF THE DISCLOSURE

In order to more clearly understand the embodiments of the present disclosure, the embodiments of the present disclosure will be further described in detail below in combination with accompanying drawings and particular embodiments. It should be noted that embodiments of the present disclosure and features in the embodiments can be combined with one another if there is no conflict.

Many details are set forth in the following description to facilitate full understanding of the present disclosure, but embodiments of the present disclosure can further be implemented in other ways different from those described herein. Therefore, the scope of protection of the present disclosure is not limited to particular embodiments disclosed below.

A hair cutting assembly 100 and a cleaning apparatus 200 provided according to some embodiments of the present disclosure will be described below with reference to FIGS. 1-8.

Figure 2:
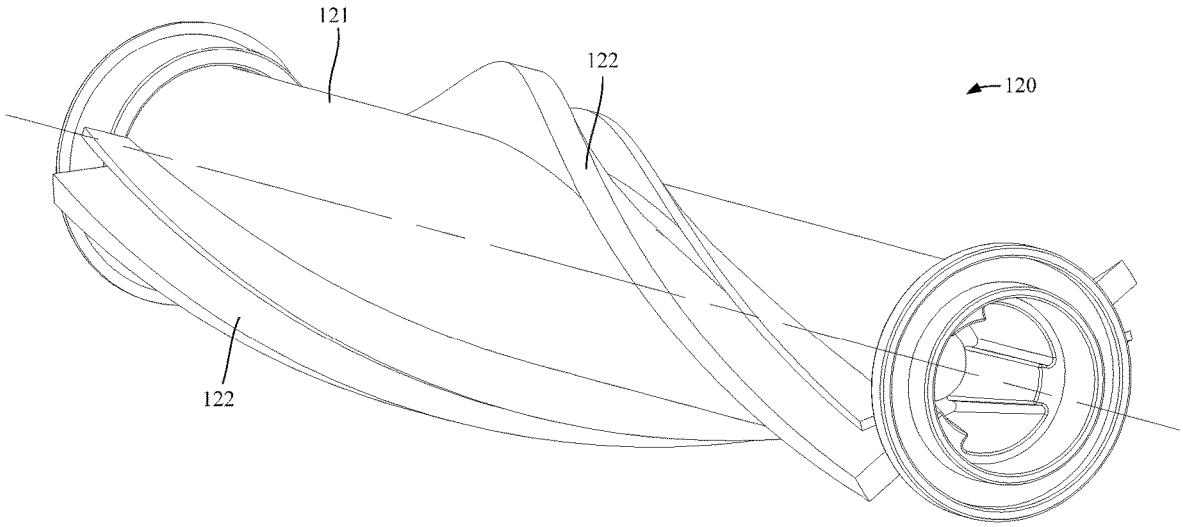
FIG. 2 shows a first schematic diagram of a roller brush according to an embodiment of the present disclosure.
Figure 3:
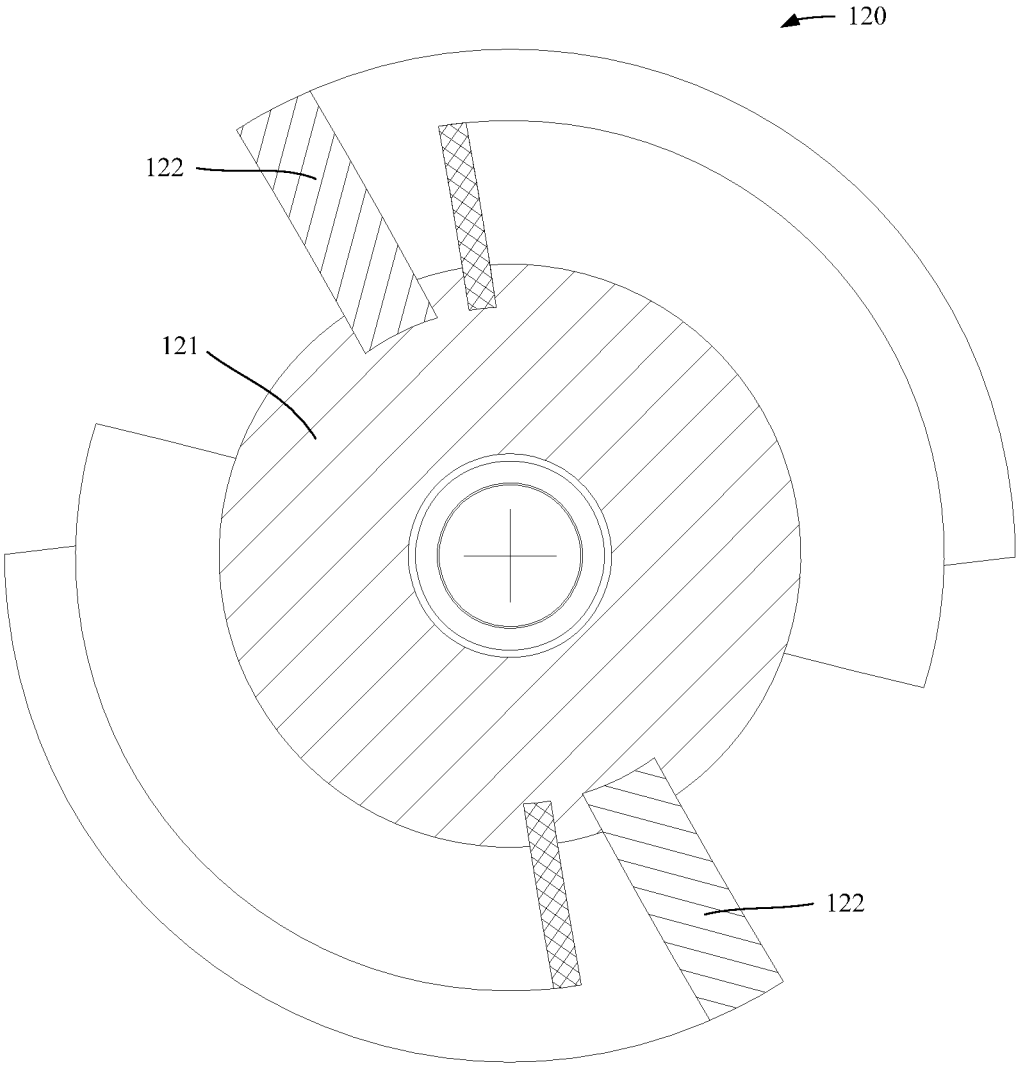
FIG. 3 shows a second schematic diagram of a roller brush according to an embodiment of the present disclosure.
Figure 4:
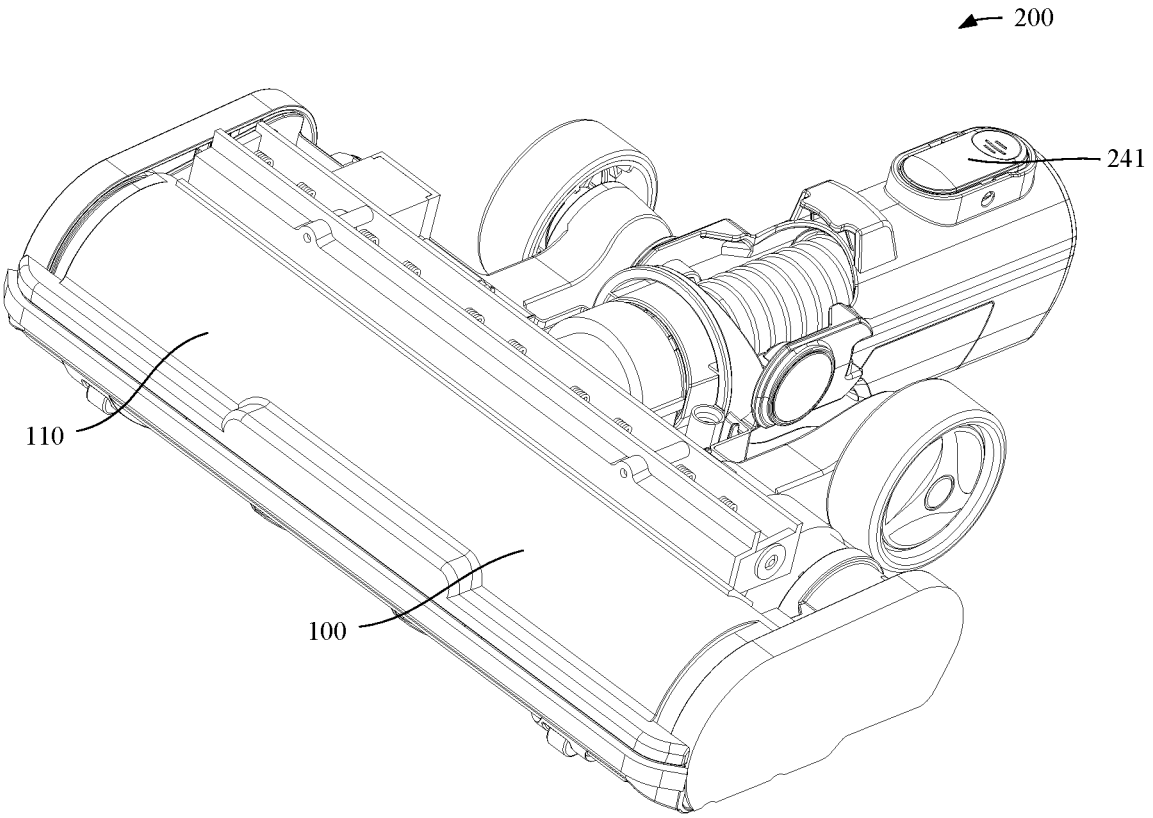
FIG. 4 shows a first schematic diagram of a cleaning apparatus according to an embodiment of the present disclosure.
Figure 5:
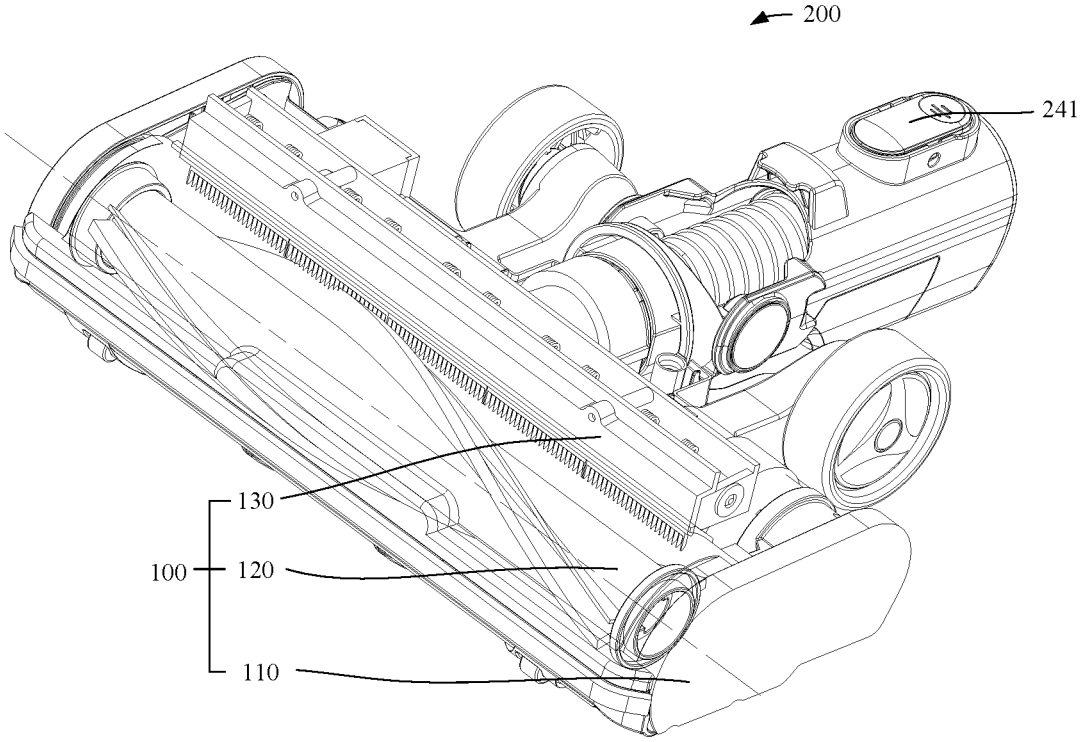
FIG. 5 shows a second schematic diagram of a cleaning apparatus according to an embodiment of the present disclosure.

In an embodiment provided according to the present disclosure, as shown in FIG. 1, the hair cutting assembly 100 includes a housing 110, a roller brush 120, a blade assembly 130 and a comb tooth 140. The roller brush 120, the blade assembly 130 and the comb tooth 140 are all connected to the housing 110, and the housing 110 mainly plays a role of a mounting carrier. Further, the roller brush 120 may rotate relative to the housing 110 along a rotation axis. In a further embodiment, as shown in FIGS. 1, 2 and 3, the roller brush 120 includes a roller 121 and rows of bristles 122 arranged on a circumferential sidewall of the roller 121. The rotation axis of the roller brush 120 may be understood as a rotation axis of the roller 121. The rotation of the roller brush 120, in one embodiment, means that the roller 121 drives the bristles 122 to rotate. When the cleaning apparatus 200 performs cleaning, the roller brush 120 makes contact with the ground, dust on the ground is beaten by the bristles 122 of the roller brush 120, and the garbage is brushed off and rolled into the housing 110.

Further, the blade assembly 130 is connected to the housing 110. In a further embodiment, as shown in FIG. 1, the blade assembly 130 includes a fixed blade 131 and a movable blade 132. The fixed blade 131 is fixed relative to the housing 110. The movable blade 132 is movable relative to the fixed blade 131. In a further embodiment, the movable blade 132 abuts against the fixed blade 131. Relative movement between the movable blade 132 and the fixed blade 131 forms an effective cutting action, and fibrous garbage (such as hair wound around the roller brush 120) is cut. In a further embodiment, the housing 110 includes a mounting housing 111, a first support housing 112 and a second support housing 113. The roller brush 120 is connected to the mounting housing 111, and the roller brush 120 may rotate relative to the mounting housing 111 along a rotation axis. The fixed blade 131 is connected to the first support housing 112, and the movable blade 132 is connected to the second support housing 113. The first support housing 112 is connected to the mounting housing 111, and the second support housing 113 is connected to the mounting housing 111. The first support housing 112 is connected to the mounting housing 111 through adhesion or welding, and the second support housing 113 is connected to the mounting housing 111 through adhesion or welding.

Further, the blade assembly 130 and the comb tooth 140 are adjacent to each other relative to a circumferential direction of the roller brush 120. The blade assembly 130 and the comb tooth 140 are located on the same side of a plane on which the rotation axis of the roller brush 120 is located. When the plane on which the rotation axis of the roller brush 120 is located rotates along with the roller brush 120 in a first rotation direction, the plane passes the comb tooth 140 and the blade assembly 130 in sequence. When garbage rotates along with the roller brush 120 in a rotation direction thereof, the garbage first makes contact with the comb tooth 140, and the comb tooth 140 intercepts and cuts part of the garbage. Then the garbage adhering to the roller brush 120 or wound around the roller brush 120 is cut by the blade assembly 130. By arranging the comb tooth 140, the blade assembly 130 can be protected to a great extent, damage to the blade assembly 130 caused by garbage is reduced, effective service time of the blade assembly 130 is ensured, and a cutting effect of the blade assembly 130 on fibrous garbage is favorably improved.

In some embodiments, as shown in FIG. 1, the blade assembly 130 includes a fixed blade 131 and a movable blade 132. The fixed blade 131 is connected to the housing 110. The fixed blade 131 is fixed relative to the housing 110. Further, the movable blade 132 is connected to the housing 110. The movable blade 132 is movable relative to the fixed blade 131. In a further embodiment, the movable blade 132 has a first station and a second station. The movable blade 132 may move from the first station to the second station or from the second station to the first station and the movable blade 132 can move close to or away from the roller brush 120. The movable blade 132 moves between the first station and the second station relative to the fixed blade 131. Relative movement between the movable blade 132 and the fixed blade 131 forms an effective cutting action, and fibrous garbage (such as hair wound around the roller brush 120) is cut.

In some embodiments, the movable blade 132 is adjacent to the fixed blade 131 in the circumferential direction, the movable blade 132 is arranged on one side of the fixed blade 131 in the circumferential direction of the roller brush 120, and the comb tooth 140 is arranged on the other side of the fixed blade 131 in the circumferential direction of the roller brush 120. In other words, the fixed blade 131 is located between the movable blade 132 and the comb tooth 140. When the plane on which the rotation axis of the roller brush 120 is located rotates along with the roller brush 120 in the first rotation direction, the plane passes the comb tooth 140, the fixed blade 131 of the blade assembly 130, and the movable blade 132 of the blade assembly 130 in sequence. When the garbage rotates along with the roller brush 120 in a rotation direction thereof, the garbage first makes contact with the comb tooth 140, then makes contact with the fixed blade 131, and finally makes contact with the movable blade 132. Part of the garbage is intercepted and cut by the comb tooth 140 and the fixed blade 131. Then the garbage adhering to the roller brush 120 or wound around the roller brush 120 is cut through the relative movement between the movable blade 132 and the fixed blade 131. The movable blade 132 can be protected to a great extent by the comb tooth 140 and the fixed blade 131, damage to the movable blade 132 caused by garbage is reduced, effective service time of the blade assembly 130 is ensured, and a cutting effect of the blade assembly 130 on fibrous garbage is favorably improved.

In some embodiments, at least one fixed blade 131 is arranged on one side of the movable blade 132 in the circumferential direction of the roller brush 120, and at least one fixed blade 131 is arranged on the other side of the movable blade 132 in the circumferential direction of the roller brush 120. When the plane on which the rotation axis of the roller brush 120 is located rotates along with the roller brush 120 in the second rotation direction, the plane passes at least one fixed blade 131 before passing the movable blade 132. The second rotation direction is opposite the first rotation direction. At least one fixed blade 131 is arranged on each of two sides of the movable blade 132 in the circumferential direction of the roller brush 120. In a further embodiment, rotation in the first rotation direction is forward rotation, and rotation in the second rotation direction is reverse rotation. No matter whether the roller brush 120 rotates forwards or reversely, when the plane on which the rotation axis of the roller brush 120 is located rotates along with the roller brush 120, the plane passes at least one fixed blade 131 and movable blade 132 in sequence. Thus, it is ensured that garbage rotating along with the roller brush 120 first makes contact with the fixed blade 131 not moving, the movable blade 132 is protected, and damage to the movable blade 132 caused by the garbage is reduced. Considering cutting effects of the fixed blade 131 and the movable blade 132 on fibrous garbage, a size of an occupied space, a degree of protecting the movable blade 132, cost and other factors, the quantity of the fixed blade 131 and the quantity of the movable blade 132 are flexibly set according to actual requirements.

In another embodiment, at least one comb tooth 140 is arranged on one side of the fixed blade 131 facing away from the movable blade 132, and at least one comb tooth 140 is arranged on one side of the movable blade 132 facing away from the fixed blade 131. When the plane on which the rotation axis of the roller brush 120 is located rotates along with the roller brush 120 in the second rotation direction, the plane passes at least one comb tooth 140 before passing the fixed blade 131 or the movable blade 132. The second rotation direction is opposite the first rotation direction. At least one comb tooth 140 is arranged on each of two sides of the blade assembly 130 in the circumferential direction of the roller brush 120. In a further embodiment, rotation in the first rotation direction is forward rotation, and rotation in the second rotation direction is reverse rotation. No matter whether the roller brush 120 rotates forwards or reversely, when the plane on which the rotation axis of the roller brush 120 is located rotates along with the roller brush 120, the plane passes at least one comb tooth 140 and the blade assembly 130 in sequence. Thus, it is ensured that the garbage rotating along with the roller brush 120 first makes contact with the comb tooth 140, the blade assembly 130 is protected, and damage to the blade assembly 130 caused by the garbage is reduced. Considering a degree of protecting the blade assembly 130, a size of an occupied space, cost and other factors, the comb tooth 140 is flexibly arranged according to actual requirements.

In some embodiments, when the plane on which the rotation axis of the roller brush 120 is located passes the comb tooth 140 and continues to rotate by a first angle, the plane on which the rotation axis of the brush roller 120 is located may pass the blade assembly 130. By controlling the first angle to be less than or equal to 25 degrees, on the one hand, there is a given distance between the comb tooth 140 and the blade assembly 130, and intercepting and cutting effects of the comb tooth 140 and the fixed blade 131 on the garbage are ensured. On the other hand, the distance between the comb tooth 140 and the blade assembly 130 is not too great, garbage rotating along with the roller brush 120 first makes contact with the comb tooth 140, the blade assembly 130 is protected, and damage to the blade assembly 130 by garbage is reduced.

In a further embodiment, the movable blade 132 and the comb tooth 140 are arranged on two sides of the fixed blade 131 respectively. A circumferential angle delimited by one end of the comb tooth 140 facing the roller brush 120, one end of the fixed blade 131 facing the roller brush 120 and the rotation axis of the roller brush 120 is not greater than 25 degrees. In other words, relative positions between the comb tooth 140 and the fixed blade 131 may be staggered by 25 degrees, and a suitable space is provided, and dust, hair and other objects can be conveniently collected.

In another embodiment, a distance between the comb tooth 140 and the fixed blade 131 is not greater than 7 mm. By controlling the distance between the comb tooth 140 and the fixed blade 131 to be less than or equal to 7 mm, it is ensured that the distance between the comb tooth 140 and the blade assembly 130 is not too great, garbage rotating along with the roller brush 120 first makes contact with the comb tooth 140, the first blade teeth of the fixed blade 131 are protected, and damage to the blade assembly 130 caused by the garbage is reduced.

Further, the fixed blade 131 has first blade teeth, and the comb tooth 140 has a plurality of second blade teeth. The comb tooth 140 has second blade teeth, and the quantity of the second blade teeth is the same as the quantity of the first blade teeth and intercepting and cutting effects of the comb tooth 140 on garbage can be favorably improved. Further, each second blade tooth corresponds to one first blade tooth of the fixed blade 131 and it is ensured that the comb tooth 140 can protect each comb tooth 140 of the fixed blade 131, damage to the movable blade 132 caused by garbage is further reduced, and a cutting effect of the blade assembly 130 on fibrous garbage is improved.

In some embodiments, as shown in FIG. 1, a tooth tip side of the fixed blade 131 faces the roller brush 120, and a tooth tip side of the movable blade 132 faces the roller brush 120. Since the tooth tip side of the blade faces the roller brush 120, part of the garbage adhering to the roller brush 120 or wound around the roller brush 120 can be cut off by a blade edge on the tooth tip side of the blade, to get unwound and sucked away. Thus, a cleaning effect of the cleaning apparatus 200 can be favorably improved. Further, the movable blade 132 has a first station and a second station, and the movable blade 132 may move from the first station to the second station or from the second station to the first station. The movable blade 132 moves along the rotation axis of the roller brush 120 to perform cutting. The movable blade 132 moves between the first station and the second station relative to the fixed blade 131. Relative movement between the movable blade 132 and the fixed blade 131 forms an effective cutting action, and fibrous garbage (such as hair wound around the roller brush 120) is cut. Thus, a cutting effect of the blade assembly 130 can be favorably improved, and a cleaning effect of the cleaning apparatus 200 is further improved.

Further, the distance between the tooth tip side of the fixed blade 131 and the rotation axis of the roller brush 120 is a first distance. A distance between the tooth tip side of the movable blade 132 located at the first station and the rotation axis of the roller brush 120 is a second distance. A distance between the tooth tip side of the movable blade 132 located at the second station and the rotation axis of the roller brush 120 is a third distance. The second distance is greater than the first distance. That is, the distance between the tooth tip side of the movable blade 132 located at the first station and the rotation axis of the roller brush 120 is greater than the distance between the tooth tip side of the fixed blade 131 and the rotation axis of the roller brush 120. The third distance is greater than the first distance. That is, the distance between the tooth tip side of the movable blade 132 located at the second station and the rotation axis of the roller brush 120 is greater than the distance between the tooth tip side of the fixed blade 131 and the rotation axis of the roller brush 120. In short, no matter whether the movable blade 132 is located at the first station or the second station, the distance between the tooth tip side of the movable blade and the rotation axis of the roller brush 120 is greater than the distance between the tooth tip side of the fixed blade 131 and the rotation axis. The garbage adhering to the roller brush 120 or wound around the roller brush 120 first makes contact with the fixed blade 131 not moving and the movable blade 132 can be favorably protected, and damage to the movable blade 132 caused by garbage is reduced. The tooth tip side of the fixed blade 131 is more protruding (closer to the roller brush 120) than the tooth tip side of the movable blade 132, and a human body is prevented from directly making contact with a blade tip of the movable blade 132 and prevented from being injured.

In another embodiment, the distance between the comb tooth 140 and the rotation axis of the roller brush 120 is a fourth distance, and the fourth distance is greater than the first distance. The distance between the comb tooth 140 and the rotation axis of the roller brush 120 is greater than the distance between the tooth tip side of the fixed blade 131 and the rotation axis of the roller brush 120. That is, the tooth tip side of the fixed blade 131 is more protruding (closer to the roller brush 120) than the comb tooth 140. On the one hand, a cutting effect of the fixed blade 131 on garbage adhering to the roller brush 120 or wound around the roller brush 120 can be ensured. On the other hand, the movable blade 132 can be favorably protected, and damage to the movable blade 132 caused by the garbage is reduced.

In another embodiment, the second distance is greater than the third distance. That is, a distance between the tooth tip side of the movable blade 132 located at the first station and the rotation axis of the roller brush 120 is greater than the distance between the tooth tip side of the movable blade 132 located at the second station and the rotation axis of the roller brush 120. When the movable blade 132 moves from the first station to the second station, the movable blade 132 gradually moves close to the roller brush 120. When the movable blade 132 moves from the second station to the first station, the movable blade 132 gradually moves away from the roller brush 120. The difference between the third distance and the first distance is not less than 0.1 mm. That is, a difference of the third distance minus the first distance is greater than or equal to 0.1 mm. On the one hand, it is ensured that the third distance is greater than the first distance, and garbage adhering to the roller brush 120 or wound around the roller brush 120 first makes contact with the fixed blade 131 not moving, and the movable blade 132 is protected. On the other hand, the difference between the third distance and the first distance is controlled not to be too large, and the cutting effect of the movable blade 132 on the fibrous garbage is ensured.

In an embodiment provided according to the present disclosure, as shown in FIGS. 4, 5, 6 and 7, the cleaning apparatus 200 includes the hair cutting assembly 100 of any one of the above embodiments, a first driving member 211 and a second driving member 212. The first driving member 211 is connected to the roller brush 120 of the hair cutting assembly 100, and the first driving member 211 is configured to drive the roller brush 120 to rotate along a rotation axis. The first driving member 211 drives the roller brush 120 to rotate in a first rotation direction or a second rotation direction. In a further embodiment, rotation of the roller brush 120 in the first rotation direction is forward rotation of the roller brush 120, and rotation of the roller brush 120 in the second rotation direction is reverse rotation of the roller brush 120. When the cleaning apparatus 200 performs cleaning, the roller brush 120 makes contact with the ground, dust on the ground is beaten by the bristles 122 of the roller brush 120, and the garbage is brushed off and rolled into a cavity 114 of the housing 110.

Further, the second driving member 212 is connected to the movable blade 132 of the hair cutting assembly 100, and the second driving member 212 is configured to drive the movable blade 132 to move relative to the fixed blade 131 of the hair cutting assembly 100. Relative movement between the movable blade 132 and the fixed blade 131 forms an effective cutting action, and fibrous garbage (such as hair wound around the roller brush 120) is cut, and a cleaning effect is improved.

Further, the controller 220 is connected to the first driving member 211, and the controller 220 is connected to the second driving member 212. A control method of the controller 220 includes: determine that the roller brush 120 is in a working state, and control the movable blade 132 to be always in a moving state; determine that the roller brush 120 is in a working state, and control the movable blade 132 to intermittently move; determine that the roller brush 120 is in a working state, control the movable blade 132 to be in a moving state, and control the movable blade 132 to stop moving after a time threshold; determine that the roller brush 120 is not in a working state, and control the movable blade 132 to be in a moving state; or control the movable blade 132 to be in a moving state, and control the roller brush 120 to reversely rotate.

Figure 6:
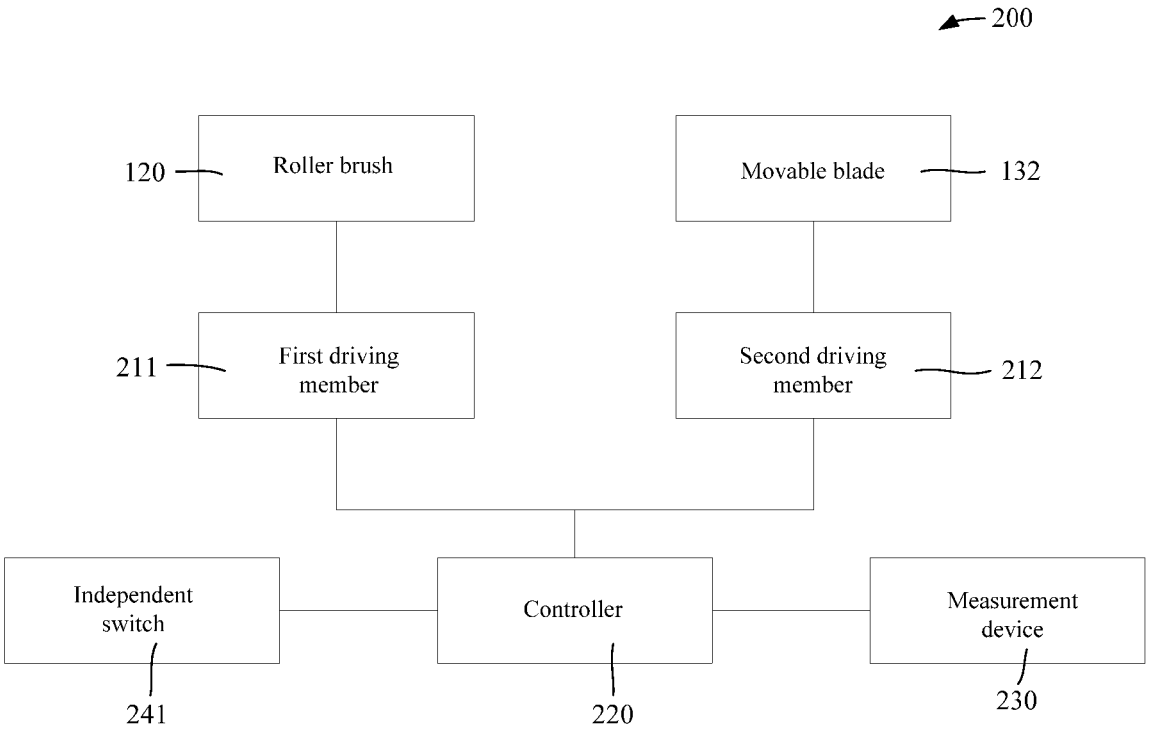
FIG. 6 shows a third schematic diagram of a cleaning apparatus according to an embodiment of the present disclosure.
Figure 7:
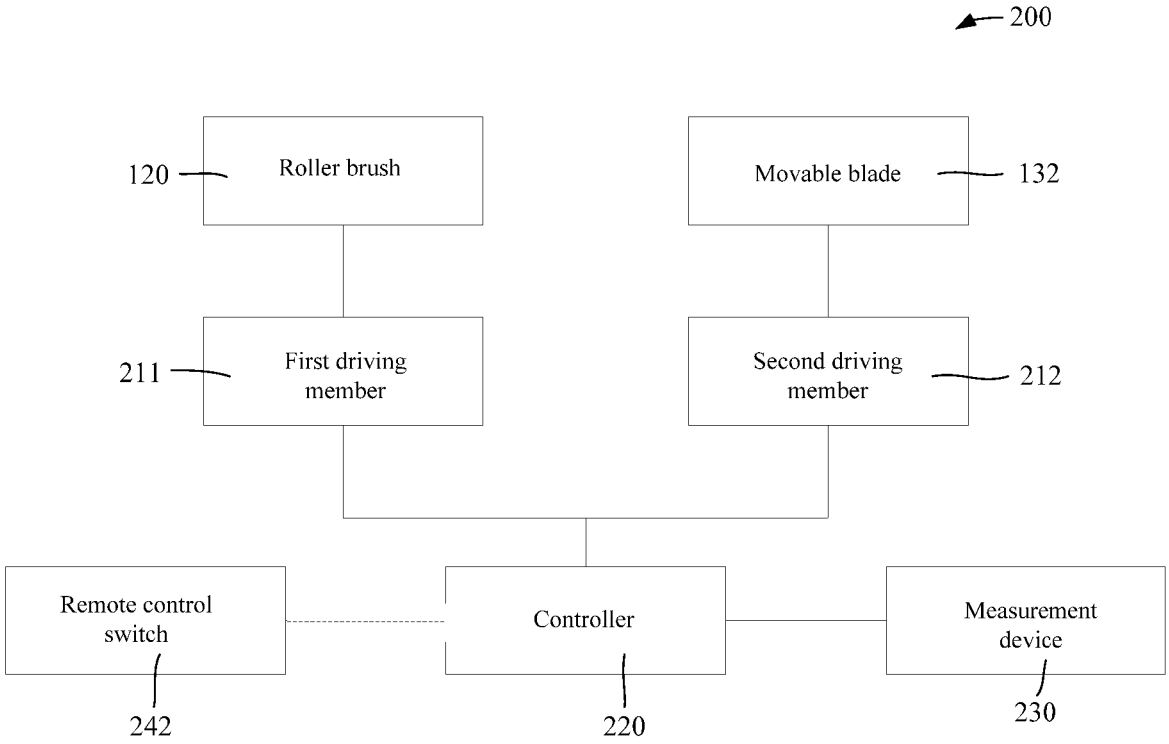
FIG. 7 shows a fourth schematic diagram of a cleaning apparatus according to an embodiment of the present disclosure.

In some embodiments, as shown in FIGS. 6 and 7, the cleaning apparatus 200 further includes a measurement device 230. The measurement device 230 is connected to the controller 220. The measurement device 230 is configured to measure the quantity of garbage adhering to or wound around the roller brush 120. The controller 220 can control a moving state of the movable blade 132 according to information about the quantity of garbage provided by the measurement device 230. A control method is as follows: determine that the roller brush 120 is in a working state, and control, in a case that it is determined according to the measurement device 230 that garbage on the roller brush 120 is greater than a first threshold, the movable blade 132 to be in a moving state; or control the movable blade 132 to be in a moving state, and control, in a case that it is determined according to the measurement device 230 that garbage on the roller brush 120 is less than a second threshold, the movable blade 132 to stop moving. The second threshold is not greater than the first threshold. It can be understood that the first threshold may be the same as or different from the second threshold. In a case that the first threshold is different from the second threshold, the second threshold is less than the first threshold.

In some embodiments, the measurement device 230 is connected to the housing 110 of the hair cutting assembly 100, and the measurement device 230 is an optical identification camera; or the measurement device 230 is connected to the first driving member 211, and the measurement device 230 is configured to measure a current value of the first driving member 211. The measurement device 230 has two solutions, the first one is an optical identification camera, and the quantity of garbage adhering to the roller brush 120 or wound around the roller brush 120 is intuitively determined by the optical identification camera. The second one is an electronic device configured to measure a current value of the first driving member 211. In a case that the current value is greater than a threshold, it is indicated that there is more garbage adhering to the roller brush 120 or wound around the roller brush 120. In a case that the current value is not greater than the threshold, it is indicated that there is less garbage adhering to the roller brush 120 or wound around the roller brush 120.

In another embodiment, as shown in FIG. 6, the cleaning apparatus 200 further includes an independent switch 241, and the independent switch 241 is connected to the controller 220. The controller 220 can control, according to on-off information of the independent switch 241, the movable blade 132 to keep a moving state or not. The independent switch 241 is linked to the controller 220 by a harness. The independent switch 241 is arranged on the housing 110. The independent switch 241 may be understood as a physical switch or an entity switch.

In another embodiment, as shown in FIG. 7, the cleaning apparatus 200 further includes a remote control switch 242, and the independent switch 241 is connected to the controller 220. The controller 220 can control, according to on-off information of the remote control switch 242, the movable blade 132 to keep a moving state or not. The remote control switch 242 is connected to the controller 220 in a communication manner. The remote control switch 242 may be understood as a switch arranged independent from the housing 110.

Figure 8:
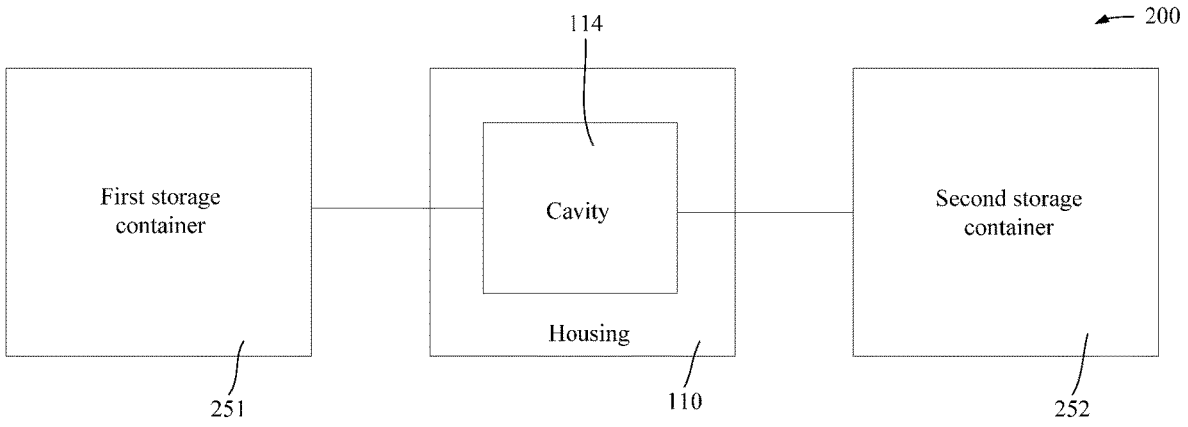
FIG. 8 shows a fifth schematic diagram of a cleaning apparatus according to an embodiment of the present disclosure.

In another embodiment, as shown in FIG. 8, the cleaning apparatus 200 further includes a first storage container 251 and a second storage container 252. The first storage container 251 is connected to the housing 110 of the hair cutting assembly 100. The first storage container 251 is configured to store a cleaning liquid. The first storage container 251 is in communication with the cavity 114 of the hair cutting assembly 100. Further, the second storage container 252 is connected to the housing 110. The second storage container 252 is configured to store garbage and sewage. The second storage container 252 is in communication with the cavity 114 of the hair cutting assembly 100. A surface of the roller brush 120 is coated with the cleaning liquid stored in the first storage container 251, and a cleaning effect is improved. The garbage rolled up by the roller brush 120, the cut garbage, and the treated sewage all flow into the second storage container 252, and a user can pour out the garbage and sewage stored in the second storage container 252 after cleaning is finished.

In an embodiment provided according to the present disclosure, a control method is further configured for the controller of the cleaning apparatus in the above embodiment. The control method includes:

determine that the roller brush of the cleaning apparatus is in a working state, and control the movable blade of the cleaning apparatus to be always in a moving state; determine that the roller brush of the cleaning apparatus is in a working state, and control the movable blade of the cleaning apparatus to intermittently move; determine that the roller brush of the cleaning apparatus is in a working state, control the movable blade of the cleaning apparatus to be in a moving state, and control the movable blade to stop moving after a time threshold;

determine that the roller brush of the cleaning apparatus is not in a working state, and control the movable blade of the cleaning apparatus to be in a moving state; control the movable blade of the cleaning apparatus to be in a moving state, and control the roller brush of the cleaning apparatus to reversely rotate; control the movable blade of the cleaning apparatus to keep a moving state or not according to an independent switch of the cleaning apparatus; control the movable blade of the cleaning apparatus to keep a moving state or not according to a remote control switch of the cleaning apparatus; or control a moving state of the movable blade of the cleaning apparatus according to the measurement device of the cleaning apparatus.

In another embodiment, the step of controlling a moving state of the movable blade of the cleaning apparatus according to the measurement device of the cleaning apparatus is as follows:

determine that the roller brush of the cleaning apparatus is in a working state, and control the movable blade to be in a moving state in a case that it is determined according to the measurement device that garbage on the roller brush is greater than a first threshold; or control the movable blade to be in a moving state, and control the movable blade to stop moving in a case that it is determined according to the measurement device that garbage on the roller brush is less than a second threshold. The second threshold is not greater than the first threshold. It can be understood that the first threshold may be the same as or different from the second threshold. In a case that the first threshold is different from the second threshold, the second threshold is less than the first threshold.

According to embodiments of the hair cutting assembly and the cleaning apparatus in the present disclosure, when garbage rotates along with the roller brush in a rotation direction thereof, the garbage first makes contact with the comb tooth, and the comb tooth intercepts and cuts part of the garbage. Then garbage adhering to the roller brush or wound around the roller brush is cut by the blade assembly. By arranging the comb tooth, the blade assembly can be protected to a great extent, damage to the blade assembly caused by garbage is reduced, effective service time of the blade assembly is ensured, and a cutting effect of the blade assembly on fibrous garbage is favorably improved.

In the present disclosure, the terms "first", "second" and "third" are merely used for a descriptive purpose and cannot be understood as indicating or implying relative importance. The term "plurality" refers to two or above, unless explicitly defined otherwise. The terms "mount", "connected", "connection", "fixed", etc. should be understood in a broad sense. For instance, "connection" can indicate fixed connection, detachable connection or integrated connection, and "connected" can indicate direct connection or indirect connection via an intermediary medium. The specific meanings of the above terms in the present disclosure can be understood according to specific circumstances.

In the description of the present disclosure, it should be understood that orientational or positional relations indicated by the terms "up", "down", "left", "right", "front", "rear", etc. are based on orientational or positional relations shown in accompanying drawings, are merely for facilitating the description of the present disclosure and simplifying the description, rather than indicating or implying that a device or unit referred to must have a particular orientation or be constructed and operated in a particular orientation, and therefore cannot be understood as limiting the present disclosure.

In the description, the terms "an embodiment", "some embodiments", "particular embodiment", etc. mean that a specific feature, structure, material or characteristic described in combination with the embodiment or instance is included in at least one embodiment or instance of the present disclosure. In the description, the schematic expressions of the above terms do not certainly refer to the same embodiment or instance. Moreover, the specific feature, structure, material or characteristic described can be combined in a suitable manner in any one or more embodiment or instances.

What is claimed is:

1. A hair cutting assembly, comprising:

a housing;

a roller brush connected to the housing and is configured to rotate relative to the housing along a rotation axis;

a blade assembly connected to the housing; and a comb tooth connected to the housing, wherein the blade assembly is adjacent to the comb tooth relative to a circumferential direction of the roller brush, and when a plane on which the rotation axis is located rotates along with the roller brush in a first rotation direction, the plane passes the comb tooth and the blade assembly in sequence, wherein the blade assembly comprises:

a fixed blade connected to the housing and fixed relative to the housing; and a movable blade connected to the housing, wherein the movable blade is movable relative to the fixed blade, the movable blade is adjacent to the fixed blade in the circumferential direction, the movable blade is arranged on a first side of the fixed blade in the circumferential direction, the comb tooth is arranged on a second side of the fixed blade in the circumferential direction, and when the plane rotates along with the roller brush in the first rotation direction, the plane passes the comb tooth, the fixed blade and the movable blade in sequence.

2. The hair cutting assembly according to claim 1, wherein at least one fixed blade is arranged on a first side of the movable blade in the circumferential direction, at least one fixed blade is arranged on a second side of the movable blade in the circumferential direction, when the plane rotates along with the roller brush in a second rotation direction, the plane passes the at least one fixed blade before passing the movable blade, and the second rotation direction is opposite the first rotation direction.

3. The hair cutting assembly according to claim 1, wherein at least one comb tooth is arranged on a first side of the fixed blade facing away from the movable blade, at least one comb tooth is arranged on a first side of the movable blade facing away from the fixed blade, when the plane rotates along with the roller brush in a second rotation direction, the plane passes the at least one comb tooth before passing the fixed blade or the movable blade, and the second rotation direction is opposite the first rotation direction.

4. The hair cutting assembly according to claim 1, wherein the plane passes the blade assembly after passing the comb tooth and continuing to rotate by a first angle, and the first angle is not greater than 25 degrees.

5. The hair cutting assembly according to claim 1, wherein a distance between the comb tooth and the fixed blade is not greater than 7 mm.

6. The hair cutting assembly according to claim 1, wherein the fixed blade has a plurality of first blade teeth, the comb tooth has a plurality of second blade teeth, the quantity of the second blade teeth is the same as the quantity of the first blade teeth, and each second blade tooth corresponds to one first blade tooth.

7. The hair cutting assembly according to claim 1, wherein a tooth tip side of the fixed blade faces the roller brush, a tooth tip side of the movable blade faces the roller brush, the movable blade has a first station and a second station, the movable blade moves from the first station to the second station or from the second station to the first station.

8. The hair cutting assembly according to claim 7, wherein a distance between the tooth tip side of the fixed blade and the rotation axis is a first distance, a distance between the tooth tip side of the movable blade located at the first station and the rotation axis is a second distance, a distance between the tooth tip side of the movable blade located at the second station and the rotation axis is a third distance, the second distance is greater than the first distance, and the third distance is greater than the first distance.

9. The hair cutting assembly according to claim 8, wherein a distance between the comb tooth and the rotation axis is a fourth distance, and the fourth distance is greater than the first distance.

10. The hair cutting assembly according to claim 8, wherein the second distance is greater than the third distance, and a difference between the third distance and the first distance is not less than 0.1 mm.

11. A cleaning apparatus, comprising:

a hair cutting assembly, comprising:

a housing;

a roller brush connected to the housing and capable of rotating relative to the housing along a rotation axis;

a blade assembly connected to the housing; and a comb tooth connected to the housing, wherein the blade assembly is adjacent to the comb tooth relative to a circumferential direction of the roller brush, and when a plane on which the rotation axis is located rotates along with the roller brush in a first rotation direction, the plane passes the comb tooth and the blade assembly in sequence;

a first driving member connected to a roller brush of the hair cutting assembly, wherein the first driving member is configured to drive the roller brush to rotate along a rotation axis; and a second driving member connected to a movable blade of the hair cutting assembly, wherein the second driving member is configured to drive the movable blade to move relative to a fixed blade of the hair cutting assembly; and a controller connected to the first driving member and the second driving member.

12. The cleaning apparatus according to claim 11, further comprising:

a measurement device connected to the controller, the measurement device being configured to measure the quantity of garbage adhering to or wound around the roller brush.

13. The cleaning apparatus according to claim 12, wherein the measurement device is connected to a mounting housing of the hair cutting assembly, and the measurement device is an optical identification camera; or the measurement device is connected to the first driving member, and the measurement device is configured to measure a current value of the first driving member.

14. The cleaning apparatus according to claim 13 further comprising:

a first storage container connected to the mounting housing of the hair cutting assembly, the first storage container being configured to store a cleaning liquid, and being in communication with a cavity of the hair cutting assembly; and a second storage container connected to the mounting housing of the hair cutting assembly, the second storage container being configured to store garbage and sewage, and being in communication with the cavity of the hair cutting assembly.

15. The cleaning apparatus according to claim 11, wherein the blade assembly comprises:

a fixed blade connected to the housing and fixed relative to the housing; and a movable blade connected to the housing, wherein the movable blade is movable relative to the fixed blade, the movable blade is adjacent to the fixed blade in the circumferential direction, the movable blade is arranged on a first side of the fixed blade in the circumferential direction, the comb tooth is arranged on a second side of the fixed blade in the circumferential direction, and when the plane rotates along with the roller brush in the first rotation direction, the plane passes the comb tooth, the fixed blade and the movable blade in sequence.

16. The cleaning apparatus according to claim 15, wherein at least one fixed blade is arranged on a first side of the movable blade in the circumferential direction, at least one fixed blade is arranged on a second side of the movable blade in the circumferential direction, when the plane rotates along with the roller brush in a second rotation direction, the plane passes the at least one fixed blade before passing the movable blade, and the second rotation direction is opposite the first rotation direction.

17. The cleaning apparatus according to claim 15, wherein at least one comb tooth is arranged on a first side of the fixed blade facing away from the movable blade, at least one comb tooth is arranged on a first side of the movable blade facing away from the fixed blade, when the plane rotates along with the roller brush in a second rotation direction, the plane passes the at least one comb tooth before passing the fixed blade or the movable blade, and the second rotation direction is opposite the first rotation direction.

18. The cleaning apparatus according to claim 15, wherein a distance between the comb tooth and the fixed blade is not greater than 7 mm.

19. The cleaning apparatus according to claim 11, wherein the plane passes the blade assembly after passing the comb tooth and continuing to rotate by a first angle, and the first angle is not greater than 25 degrees.

* * * * *